US008082763B2

(12) United States Patent
Giordano

(10) Patent No.: US 8,082,763 B2
(45) Date of Patent: Dec. 27, 2011

(54) SYSTEM FOR DETECTING OPERATING PARAMETERS OF AN ELECTRIC HOUSEHOLD APPLIANCE FEATURING A RELATIVELY MOVABLE COMPONENT

(75) Inventor: Sergio Giordano, Caselle Torinese (IT)

(73) Assignee: ITW METALFLEX, druzba za proizvodnjo delov za gospodinsjke aparate, d.o.o. Tolmin, Tolmin (SI)

( * ) Notice: Subject to any disclaimer, the term of this patent is extended or adjusted under 35 U.S.C. 154(b) by 748 days.

(21) Appl. No.: 12/067,420

(22) PCT Filed: Sep. 19, 2006

(86) PCT No.: PCT/IB2006/002594

§ 371 (c)(1),
(2), (4) Date: May 29, 2008

(87) PCT Pub. No.: WO2007/034292

PCT Pub. Date: Mar. 29, 2007

(65) Prior Publication Data

US 2008/0264111 A1 Oct. 30, 2008

(30) Foreign Application Priority Data

Sep. 20, 2005 (IT) ..... TO2005A0644

(51) Int. Cl.
*D06F 33/00* (2006.01)

(52) U.S. Cl. ..... 68/12.04

(58) Field of Classification Search ..... 68/12.04, 68/12.05, 12.06, 12.19, 23 R, 23.1, 23.2, 68/23.3, 24

See application file for complete search history.

(56) References Cited

U.S. PATENT DOCUMENTS

| | | | | |
|---|---|---|---|---|
| 3,967,504 | A | 7/1976 | Akeley | |
| 4,006,402 | A | 2/1977 | Mincuzzi | |
| 4,165,653 | A | 8/1979 | Morehouse | |
| 5,760,577 | A | 6/1998 | Shizuya | |
| 5,955,191 | A | 9/1999 | Hirokane et al. | |
| 7,631,522 | B2 * | 12/2009 | Bindocci et al. | 68/12.04 |

(Continued)

FOREIGN PATENT DOCUMENTS

| | | |
|---|---|---|
| CN | 1465960 | 1/2004 |

(Continued)

OTHER PUBLICATIONS

ISR for PCT/IB2006/002594 dated Feb. 7, 2007.

*Primary Examiner* — Michael Barr
*Assistant Examiner* — David Cormier
(74) *Attorney, Agent, or Firm* — Lowe Hauptman Ham & Berner LLP

(57) ABSTRACT

A system for detecting the operative parameters of a household appliance, such as a washing machine or dryer, provided with a relatively mobile component with respect to a load-bearing frame (tank or basket), including a pressure switch including in turn a rigid casing accommodating a deformable membrane sensitive to hydraulic pressure, a ferromagnetic material core engaged to the membrane and a winding fixed to the casing and operatively coupled with the core to form a variable inductance electrical inductor; in which the pressure switch is coupled to the relatively mobile member to follow its movements; and in which said variable inductance electrical inductor is operatively associated to a ferromagnetic material bracket integrally carried by the load-bearing body and arranged outside the pressure switch.

18 Claims, 2 Drawing Sheets

U.S. PATENT DOCUMENTS

| | | | |
|---|---|---|---|
| 2005/0000291 | A1 | 1/2005 | Shirai et al. |
| 2008/0155847 | A1 | 7/2008 | McAllister |

FOREIGN PATENT DOCUMENTS

| | | | |
|---|---|---|---|
| DE | 4444167 | | 7/1995 |
| FR | 2767194 | A1 | 2/1999 |
| GB | 2225030 | A | 5/1990 |
| GB | 2423372 | | 8/2006 |
| JP | 63191937 | | 8/1988 |
| JP | 10049926 | | 2/1998 |
| JP | 2000019046 | | 1/2000 |
| JP | 2001170393 | | 6/2001 |
| KR | 20030009848 | | 2/2003 |
| WO | 03/078951 | | 9/2003 |

* cited by examiner

SYSTEM FOR DETECTING OPERATING PARAMETERS OF AN ELECTRIC HOUSEHOLD APPLIANCE FEATURING A RELATIVELY MOVABLE COMPONENT

RELATED APPLICATIONS

The present application is based on International Application Number PCT/IB2006/002594 filed Sep. 19, 2006, and claims priority from Italian Application Number TO2005A000644 filed Sep. 20, 2005, the disclosures of which are hereby incorporated by reference herein in their entirety.

TECHNICAL FIELD

The present invention relates to a system for detecting operative parameters in a household appliance provided with a relatively mobile component with respect to the load-bearing frame of the household appliance itself, such as for example a tank or basket of a washing machine, drier or the like.

BACKGROUND ART

It is known that in household appliances of the aforesaid type, a number of operative parameters must be known in order to ensure correct operation, such as for example, the weight of the linen contained in the basket, the degree of uniformity with which the linen is distributed in the basket, the pressure and/or quantity of feeding water, etc.

French patent application FR-A-2767194 describes a detection system of a number of such parameters using a pressure switch (pressure transducer) connected to the water feeding system of the household appliance and coupled to a water-tight tank containing the rotating basket of the household appliance (washing machine or dryer); the tank, as known, is connected to the load-bearing frame of the household appliance which supports it by means of elastic, possibly shock-absorbing, elements, making it therefore relatively mobile with respect to the load-bearing frame, consequent to the load applied to it by the basket, which in use contains the linen to be washed or dried.

The pressure switch includes a rigid casing accommodating a deformable membrane sensitive to hydraulic pressure, a ferromagnetic material core fastened to the membrane and a winding carried by the casing and operatively coupled to the core to form a variable inductance electrical inductor. The end-of-stroke stop which defines the system zero position is defined by a spring. In this way, the pressure switch is capable of detecting the hydraulic pressure which acts in use on the membrane, producing a signal (generally linear) correlated to the same and, furthermore, is capable of varying such signal according to the vibrations to which the basket (and consequently the tank with contains it) is subject in use, therefore allowing the generation of an electrical signal indicating the direction and amplitude of the basket vibrations.

The detection system described is not however free from drawbacks; firstly, it does not allow to detect the static load of the basket, i.e. the weight of the linen it contains, which must be set by hand by the user on the control panel of the household appliance, nearly always by approximation and consequently imprecisely. Furthermore, also due to the presence of a "mobile" stop defined by the spring, it is relatively large in size and presents a certain difficulty in assembly, in addition having a relatively high production cost.

DISCLOSURE OF INVENTION

It is the object of the present invention to solve the described drawbacks by providing a system for detecting the operative parameters of a household appliance provided with a relatively mobile component with respect to the load-bearing frame of the household appliance itself, for example the tank or basket of a washing machine or dryer, which is small in size, low-cost, easy to assembly, reliable to operate, and which allows to detect not only the hydraulic pressure and the vibrations of the basket, but also the weight of the linen accommodated inside the basket itself.

The present invention therefore relates to a system for the detection of operative parameters of a household appliance of the aforesaid type, as defined in claim 1.

In particular, the household appliance includes a relatively mobile component with respect to a load-bearing frame of the household appliance, for example a tank or a basket, and the system according to the invention comprises a pressure switch, comprising in turn a rigid casing accommodating a deformable membrane sensitive to hydraulic pressure, a ferromagnetic material core fastened to the membrane and a winding fastened to the casing and operatively coupled to the core to form a variable inductance electrical inductor; the pressure switch is coupled with the relatively mobile member to follow its movements and the variable inductance electrical inductor is operatively associated to a ferromagnetic material bracket integrally carried by the frame and arranged externally to the pressure switch, with a predetermined clearance between the bracket and the casing, so that the pressure switch is adapted to output an electrical signal in response to a variation of the clearance induced by a relative movement between bracket and casing consequent to each variation of position of the relatively mobile member with respect to the frame.

The pressure switch also comprises an electronic circuit made on a board carried inside the casing, one part of which is adapted to determine, according to the electrical signal in response to a variation of clearance (g) between bracket and casing and in static conditions, the weight of an active load placed within said relatively mobile member and, on the basis of the electrical signal itself, but in dynamic conditions, the entity in direction and amplitude of possible vibrations of the relatively mobile member.

If the relatively mobile member is a tank of a washing machine or dryer accommodating inside a rotating basket for a laundry load, said static conditions correspond to a condition in which the basket does not rotate, and said dynamic conditions correspond to a condition in which the basket rotates.

The pressure switch also comprises a fixed abutting element for the membrane, integral with the casing, against which the membrane rests when the pressure switch is in zero condition, in which the membrane is undeformed; and the electrical signal in response to the variation of clearance (g) between bracket and casing represents a variation of the inductance of said electrical inductor with the pressure switch in said zero condition.

In this way, it is obtained a system which uses a pressure switch which is small in size, low-cost and easy to assembly, in which the pressure switch, in addition to its proper function of detecting hydraulic pressure, may at the same time measure both the weight of the linen contained in the basket, when the basket is stationary, and the entity of the vibrations of the basket, when the basket is operating, thus allowing to determine whether the load is balanced or not. This is all obtained with extremely small dimensions and at negligible costs, represented solely by the position of the bracket and by an intervention on the layout of the electronic board, which would be present in any case.

BRIEF DESCRIPTION OF THE DRAWINGS

Further features and advantages of the present invention will be apparent in the description that follows of a non-limitative embodiment thereof, with reference to the accompanying drawings, in which.

BEST MODE FOR CARRYING OUT THE INVENTION

Figure 1:
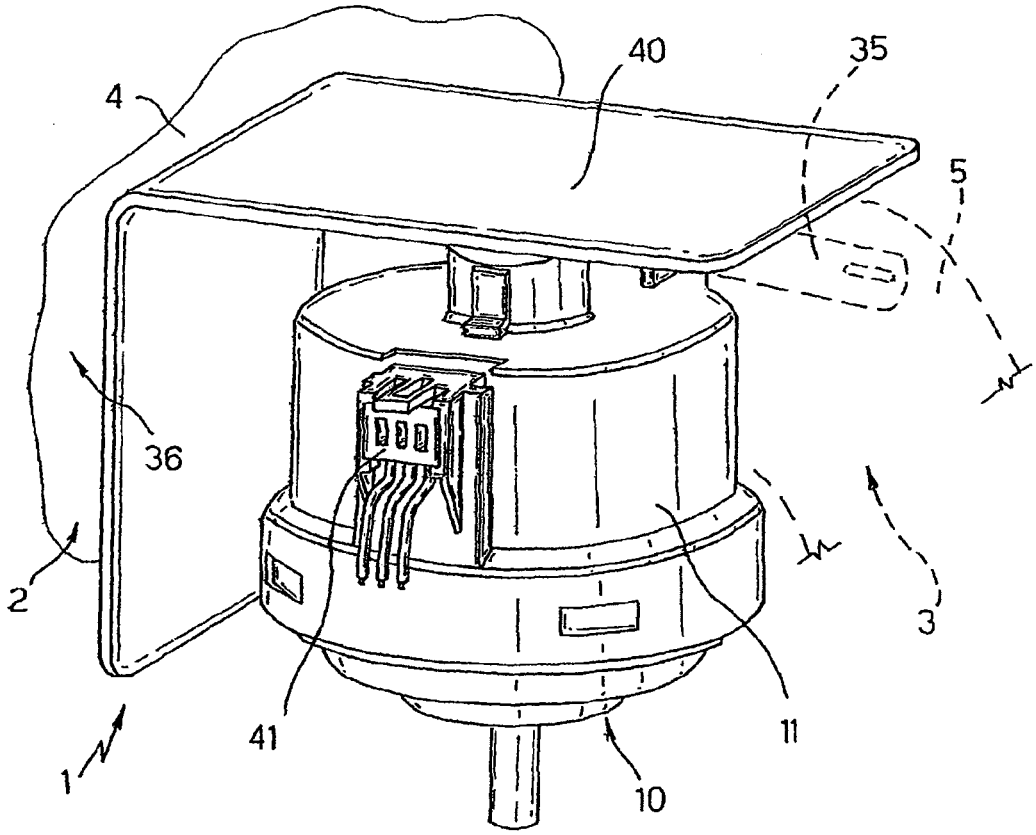
FIG. 1 schematically shows a system for detecting the operative parameters of a household appliance, in the example shown a washing machine or dryer, made according to the invention.

With reference to figures from 1 to 4, number 1 indicates as a whole a system for detecting operative parameters of a household appliance 2 provided with a relatively mobile component with respect to a load-bearing frame 4 of the household appliance 2; in the case in point illustrated as a non-limitative example, the household appliance 2 is a washing machine or dryer and the relatively mobile member 3 includes a water-tight tank 5 accommodating within a rotating basket 6 of the known type.

Figure 2:
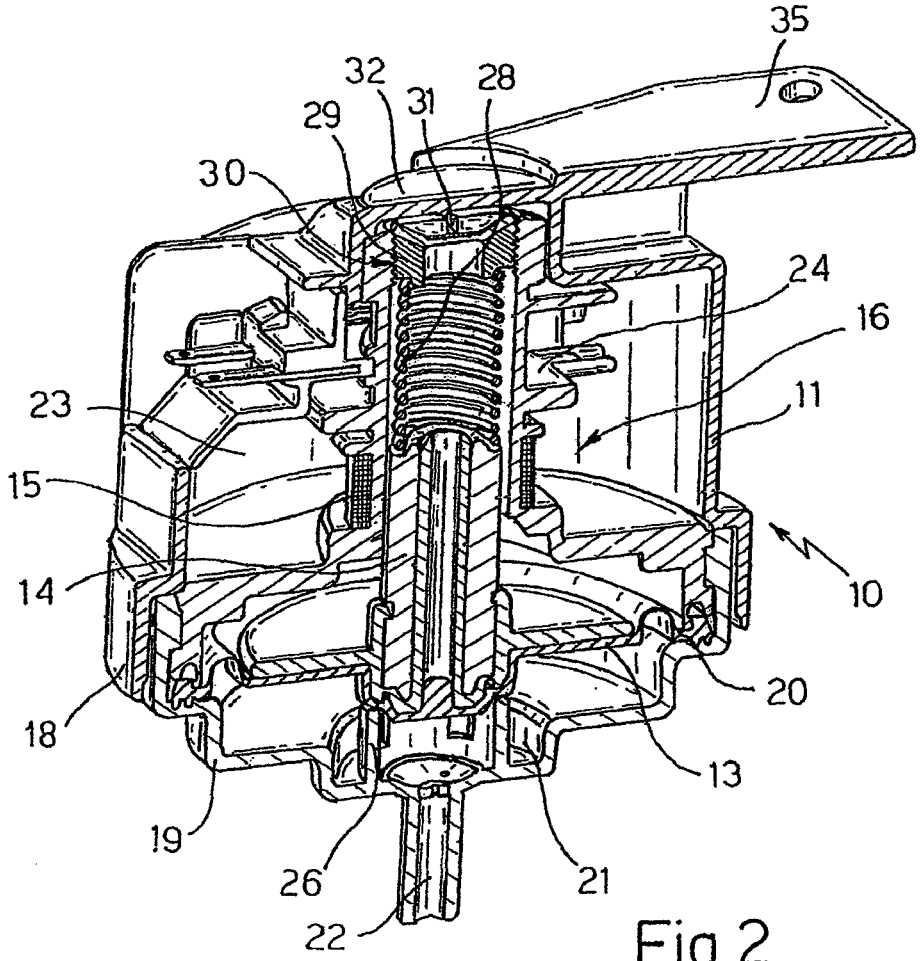
FIG. 2 shows a perspective view of a detail, partially in cross-section, of a pressure switch in the detection system in FIG. 1.

Detection system 1 comprises a pressure switch 10, comprising in turn a rigid casing 11 (FIG. 2) accommodating a deformable membrane 13, sensitive to hydraulic pressure, a ferromagnetic material core 14 fastened to membrane 13 and a winding 15 carried by casing 11 and operatively coupled with core 14 to form a variable inductance electrical inductor 16.

Figure 3:
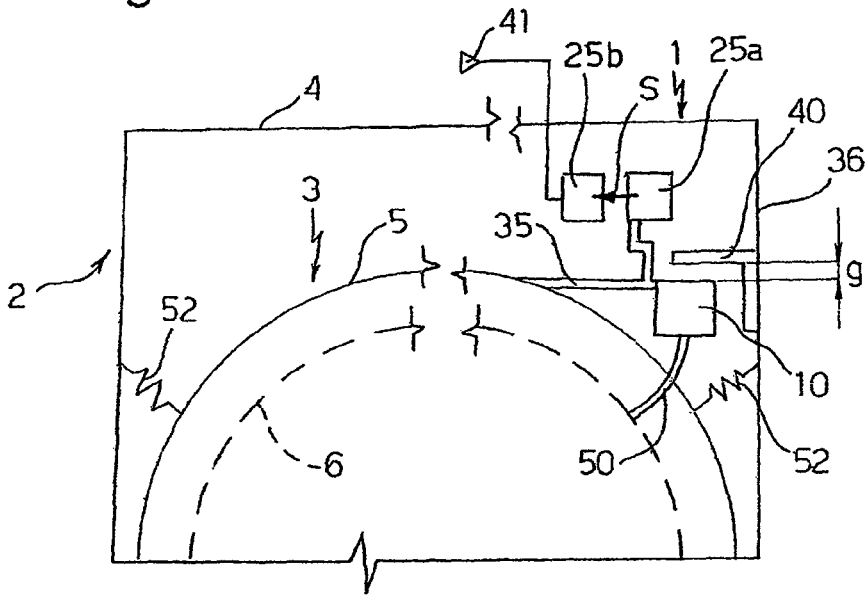
FIGS. 3 and 4 schematically show in elevation the system in FIG. 1 applied to a washing machine or dryer, in two different working configurations.

Casing 11 is made of magnetically neutral material, preferably synthetic plastic material, and is obtained by moulding, split into at least two half shells 18,19, reciprocally snappingly coupled in use, between which is fluid-tightly packed a peripheral edge 20 of membrane 13, so that membrane 13 divides the inside of casing 11 into a chamber 21 hydraulically connected with the outside via a nipple 22, and into a chamber 23 maintained at atmospheric pressure and accommodating within a board 24 carrying an electronic circuit 25, for simplicity shown only schematically by two blocks 25*a* and 25*b* in FIG. 3 only, showing two different parts of the electronic circuit 25.

Pressure switch 10 finally comprises a fixed abutting element 26 for the membrane 13, integral with casing 11 (for example being an integral part of half shell 19), against which abutting element 26 membrane 13 rests when pressure switch 10 is in zero condition, in which membrane 13 is undeformed. A contrast spring 28 for membrane 13 is arranged on the opposite side with respect to the fixed abutting element 26, sandwiched between membrane 13 and a second abutting element 29 of casing 11 with a predetermined preload.

Such second abutting element 29 is provided with adjustment means 30 for varying the preload of contrast spring 28; in the case in point, the abutting element 29 consists of a threaded dowel having an external threading 30 on the side wall and provided with a screwdriver cut 31 accessible through a removable cover 32 of casing 11.

According to the invention, pressure switch 10 is coupled to relatively mobile member 3 so as to follow its movements, in the case in point it is integrally fixed to tank 5 externally to the same, by means of a bracket 35 integrally made with casing 11, in the same plastic material of it. Bracket 35 is shaped so as to maintain pressure switch 10 in adjacent position facing a side wall 36 of load-bearing frame 4, which is, according to the invention, provided with an L-shaped bracket 40 made of ferromagnetic material, which forms, in addition to pressure switch 10, the main component of detection system 1.

Bracket 40 is shaped and positioned so as to be operatively associated to the variable inductance electrical inductor 16, is integrally carried by load-bearing frame 4 and is arranged externally to pressure switch 10, so that a predetermined clearance (g) is present (FIG. 3) between bracket 40 and casing 11.

In this way, pressure switch 10 is adapted to output an electrical signal S (indicated schematically by the arrow in FIG. 3) through a connector 41 (FIG. 1) in response to any variation of the clearance amplitude (g), for example induced by a relative movement between bracket 40 and casing 11 consequent to any variation of relative position of relatively mobile member 3 (in the case in point tank 5) with respect to load-bearing frame 4.

In particular, electrical signal S in response to a variation of clearance (g) between bracket 40 and casing 11 represents a variation of the inductance of electrical inductor 16 which occurs with pressure switch 10 in zero condition, i.e. with membrane 13 resting against abutting element 26.

Figure 4:
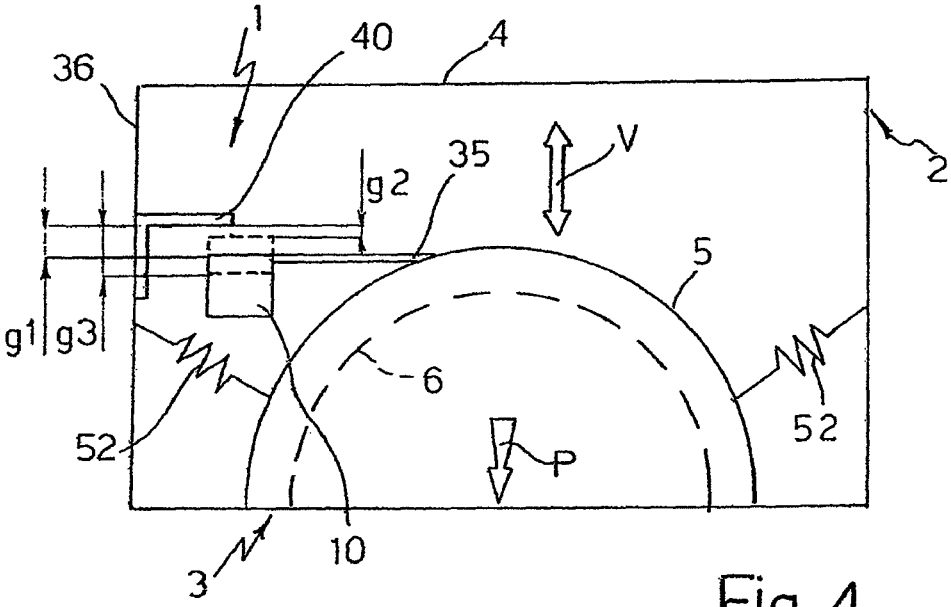

Electronic circuit 25 is made so as to determine, with its part 25*b* and according to electrical signal S, in response to a variation of clearance (g) between bracket 40 and casing 11 occurring in static conditions, weight P (FIG. 4) of an active load placed inside relatively mobile member 3, in the case in point in rotating basket 6, in turn contained within tank 5; and, according to the same electrical signal S in response to a variation of clearance (g) between bracket 40 and casing 11, but in dynamic conditions, the entity in direction and amplitude of possible vibrations V (FIG. 4) to which the relatively mobile member 3 is subjected in use, in the case in point following rotation of basket 6 containing a load of linen of weight P.

In the non-limitative example shown, in which relatively mobile member 3 is a tank 5 of a washing machine or dryer 2 accommodating inside a rotating basket 6 for a load of laundry, the aforesaid static conditions correspond to a condition in which basket 6 does not rotate (being stationary), and while said dynamic conditions correspond to a condition in which basket 6 rotates.

In use, nipple 22 is connected in a known way, through a tube 50 (FIG. 3) to the inside of tank 5, which is carried by load-bearing frame 4 by means of known suspensions 52, which allow relative movements between tank 5 and load-bearing frame 4. A hydraulic pressure present in tank 5, for example proportional to the level of water contained in tank 5, is therefore transmitted by tube 50 to membrane 13, which is deformed against the bias of spring 28 shifting ferromagnetic core 14 within winding 15; which produces in the known way a variation of inductance in inductor 16, variation which is detected by electronic circuit 25, in its part 25*a*, which produces an output signal on connector 41 of the linear type.

At the same time, the same electrical inductor 16, thanks to the presence of bracket 40 and to the fact that casing 11 is made of magnetically neutral material, is capable of generating variations of inductance following any variation of clearance (g). In particular, when basket 6 is stationary and a load of linen is introduced in it, the weight P of the latter determines an increase of clearance, therefore a value g1 of clearance (g) higher than that of the empty basket 6; the consequent variation of inductance in inductor 16 produces a signal S which is processed by part 25*b* of electronic circuit 25, thus working out the weight P of the linen present.

Similarly, when basket 6 is moving, the clearance (g) will change, consequent to the dynamic action of the weight P of the load of linen, between a minimum g2 and a maximum g3; such variations generate a consequent alternating variation of sign and value of the inductance of inductor 16, generating a variable signal S which is processed by the part 25*b* of electronic circuit 25 to generate a specific indication, for example if the linen is arranged in basket 6 so as to generate imbalance. Such signal, available at connector 41, may then be used in the known way.

The invention claimed is:

1. A system for detecting operative parameters of a household appliance provided with a relatively mobile member with respect to a load-bearing frame of the household appliance, said system comprising a pressure switch, which in turn comprises a rigid casing accommodating a deformable membrane sensitive to hydraulic pressure, a ferromagnetic material core fastened to the membrane, and a winding fastened to the casing and operatively coupled with the core to form a variable inductance electrical inductor;

wherein the pressure switch is coupled with said relatively mobile member so as to follow movements of said relatively mobile member; and said variable inductance electrical inductor is operatively associated to a ferromagnetic material bracket integrally carried by the frame and arranged externally to the pressure switch, with a predetermined clearance (g) between the bracket and the casing, so that the pressure switch is adapted to output an electrical signal (S) in response to a variation of the clearance (g) induced by a relative movement between the bracket and the casing consequent to each variation of position of the relatively mobile member with respect to the frame.

2. A system according to claim 1, wherein said casing is made of a synthetic plastic material.

3. A system according to claim 1, wherein said pressure switch further comprises a fixed abutting element for the membrane, said fixed abutting element is integral with the casing, and when the pressure switch is in zero condition, the membrane is undeformed and rests against said fixed abutting element.

4. A system according to claim 3, wherein said electrical signal (S) in response to a variation of the clearance (g) between the bracket and the casing represents a variation of the inductance of said electrical inductor with the pressure switch in said zero condition.

5. A system according to claim 4, wherein said pressure switch further comprises a contrast spring for the membrane, said contrast spring is arranged on a side opposite to said fixed abutting element, and is sandwiched between the membrane and a second abutting element of the casing with a predetermined preload.

6. A system according to claim 5, wherein said second abutting element is provided with adjustment means for varying the preload of the contrast spring.

7. A system according to claim 1, wherein the pressure switch comprises an electronic circuit on a board carried internally by the casing, said electronic circuit is adapted to determine, according to said electrical signal (S) in response to a variation of the clearance (g) between the bracket and the casing and in static conditions, the weight (P) of an active load placed inside said relatively mobile member and, on the basis of the same electrical signal (S), but in dynamic conditions, the entity in direction and in amplitude of vibrations (V) of the relatively mobile member.

8. A system according to claim 7, wherein the relatively mobile member is a tank of a washing machine or dryer accommodating inside a rotating basket for a laundry load, said static conditions correspond to a condition in which the basket does not rotate, and said dynamic conditions correspond to a condition in which the basket rotates.

9. A system according to claim 1, wherein said fixed abutting element is rigid.

10. A system according to claim 1, wherein said bracket is L-shaped.

11. In a household appliance having a load-bearing frame and a mobile member moveable relative to the load-bearing frame, a system for detecting operative parameters of the household appliance, said system comprising:

a pressure switch, which is coupled with said mobile member so as to follow movements of said mobile member and comprises a rigid casing;

a deformable membrane sensitive to hydraulic pressure and accommodated in said casing;

a winding fastened to the casing;

a ferromagnetic material core fastened to the membrane, moveable relative to the winding, and operatively coupled with the winding to form a variable inductance electrical inductor; and a ferromagnetic material bracket integrally carried by the frame and arranged externally to the pressure switch;

wherein said casing is made of a magnetically neutral material;

said variable inductance electrical inductor is operatively associated to the ferromagnetic material bracket with a clearance between the bracket and the casing, so that the pressure switch is adapted to output an electrical signal in response to a variation of the clearance induced by a relative movement between the bracket and the casing consequent to each variation of position of the mobile member with respect to the frame; and the pressure switch further comprises, on a board carried internally by the casing, means for determining (i) according to said electrical signal and in static conditions, the weight of a load placed inside said mobile member, and (ii) on the basis of said electrical signal but in dynamic conditions, the entity in direction and in amplitude of vibrations of the mobile member.

12. A system according to claim 11, wherein said bracket is L-shaped, and said casing is partially located in a rectangle having two sides defined by said L-shaped bracket.

13. A system according to claim 12, wherein said pressure switch further comprises a fixed, rigid abutting element for the membrane, said fixed, rigid abutting element is integral with the casing, and when the pressure switch is in zero condition, the membrane is undeformed and rests against said fixed, rigid abutting element.

14. A system according to claim 13, wherein said pressure switch further comprises a second abutting element inside the casing, and a contrast spring for the membrane, wherein said contrast spring is arranged on a side opposite to said fixed, rigid abutting element, and is sandwiched between the membrane and the second abutting element with a predetermined preload.

15. A system according to claim 14, wherein said second abutting element is provided with an adjustment element for varying the preload of the contrast spring.

16. A system according to claim 11, wherein the household appliance is a washing machine or dryer, the mobile member is a tank of the washing machine or dryer, said tank accommodating therein a rotating basket for a laundry load, said static conditions correspond to a condition in which the basket does not rotate, and said dynamic conditions correspond to a condition in which the basket rotates.

17. A system according to claim 16, wherein said bracket is L-shaped, and said casing is partially located in a rectangle having two sides defined by said L-shaped bracket.

18. A system according to claim 17, wherein said pressure switch further comprises a fixed, rigid abutting element for the membrane, said fixed, rigid abutting element is integral with the casing, and when the pressure switch is in zero condition, the membrane is undeformed and rests against said fixed, rigid abutting element.

* * * * *